US005839709A

United States Patent [19]

Leonard

[11] Patent Number: 5,839,709

[45] Date of Patent: Nov. 24, 1998

[54] HOLDING DEVICE FOR CONTAINERS OF MAINTENANCE FLUIDS IN ATTACHMENT WITH AN UPRIGHT HANDLE OF A MOBILE FLOOR MAINTENANCE APPARATUS

[76] Inventor: John R. Leonard, 2745 Gibson Dr., Rocky River, Ohio 44116

[21] Appl. No.: 839,451

[22] Filed: Apr. 14, 1997

[51] Int. Cl.[6] ..... A47K 1/08

[52] U.S. Cl. ..... 248/311.2; 224/39

[58] Field of Search ..... 248/311.2, 309.1, 248/310, 315, 318, 316.1, 316.2, 316.7, 313, 218.4, 230.8, 210; 224/274, 427, 454, 926, 39, 148.4–148.7; 15/339, 246.2, 321

[56] References Cited

U.S. PATENT DOCUMENTS

| | | | |
|---|---|---|---|
| 4,009,810 | 3/1977 | Shook | 224/39 |
| 4,218,900 | 8/1980 | Caplan et al. | 68/205 R |
| 4,249,280 | 2/1981 | Goodrich | 15/323 |
| 4,333,203 | 6/1982 | Yonkers | 15/321 |
| 4,386,721 | 6/1983 | Shimano | 224/39 |
| 4,437,596 | 3/1984 | Shook | 224/39 |
| 4,640,499 | 2/1987 | Blackburn | 224/41 |
| 4,655,425 | 4/1987 | Wallace et al. | 248/311.2 |
| 4,830,240 | 5/1989 | Tackles et al. | 224/35 |
| 5,060,832 | 10/1991 | Link | 224/32 R |
| 5,105,958 | 4/1992 | Patton | 215/100 R |
| 5,344,055 | 9/1994 | Edwards | 224/42.45 R |
| 5,392,971 | 2/1995 | Hsu | 224/39 |
| 5,426,570 | 6/1995 | Davis | 362/72 |
| 5,456,393 | 10/1995 | Mathis et al. | 224/148 |
| 5,593,121 | 1/1997 | Tackett | 248/218.4 |
| 5,704,525 | 1/1998 | Barro | 224/414 |

*Primary Examiner*—Ramon O. Ramirez
*Assistant Examiner*—T. Le
*Attorney, Agent, or Firm*—Thomas M. Schmitz

[57] ABSTRACT

A container holder device used in combination with attachment to an upright handle of a mobile floor maintenance apparatus used by cleaning personnel is adapted to hold and support household maintenance fluids. The container holding devices comprises a molded body structure secured to the upright handle and supporting an outwardly extending extruded support structure particularly formed to support a container of cleaning material. Impinging members on the molded body structure in conjunction with the formed extruded support means securely maintains the fluids container within the container holding device while the floor maintenance apparatus is in use.

6 Claims, 3 Drawing Sheets

HOLDING DEVICE FOR CONTAINERS OF MAINTENANCE FLUIDS IN ATTACHMENT WITH AN UPRIGHT HANDLE OF A MOBILE FLOOR MAINTENANCE APPARATUS

This invention pertains to a holding device for holding removable small containers of household or commercial maintenance materials, typically fluids such as household cleaning liquids, furniture polish, or floor wax, and more particularly to holding devices for fluids containers in combination with and attached to an upright handle on a vacuum cleaner or floor polisher or similar mobile maintenance apparatus having an upright handle.

BACKGROUND OF THE INVENTION

Cleaning personnel frequently use vacuum cleaners and similar devices with upright handles for typically cleaning rugs and carpets on floors in homes, offices, and commercial retail areas. A similar cleaning device would be a floor scrubbing or waxing apparatus with an upright handle and used to scrub and/or wax bare floors in such areas. A typical problem for cleaning personnel is the need for separate containers of liquid cleaning fluids, spray window cleaners, spray polishes, liquid or paste furniture polishes, similar household polishes, or other fluids, aerosols, or soft solid materials useful for maintaining rooms in commercial or household environments. Such maintenance fluids frequently are needed for associated cleaning or maintenance activities while cleaning rugs or polishing floors, but are too awkward or cumbersome to carry along separately while doing cleaning chores.

It now has been found that this problem can be alleviated by a detachable container holding device secured to the upright handle of a mobile maintenance apparatus for floor cleaning or polishing, where the holding device comprises an extruded wire supporting means for supporting a fluids container in cooperation with cooperating impinging means to impinge upon and secure a small container of fluid within the wire supporting means. The fluids container can be easily inserted or removed from the holding device but is maintained securely engaged within the holding device while the worker is utilizing the maintenance apparatus. These and other advantages of the invention will become more apparent by referring to the drawings and the detailed description of the invention.

SUMMARY OF THE INVENTION

Briefly, the invention comprises a container holding device for securely supporting a container of household or commercial maintenance fluid, where the holding device is adapted to be attached to an upright handle of a mobile household or commercial floor maintenance cleaning or polishing apparatus. The container holding device is attached to the upright handle in locking engagement with a formed extruded wire supporting means extending outwardly from the handle for supporting the container of fluid in an upright manner while the cleaning or polishing apparatus is being used. The container holding device structure further contains an upper impinging member extending upwardly and outwardly and a lower downwardly depending impinging member extending downwardly and outwardly, where both impinging members are sufficiently resilient to press against the fluids container to hold the fluids container tightly within the container holding device. The formed wire supporting means preferably comprises a particularly formed extruded wire adapted to hold and support the fluids container. The main body structure of the container holding device has opposed vertical locking means for securing vertical members of the extruded wire means to the body, and an upper locking means for securing two terminal ends of the formed continuous extruded wire to the body structure. The extruded supporting means is suspended outwardly from the main body structure which in turn is attached to the upright handle while maintained in secure locking engagement with the main body structure.

DESCRIPTION OF THE DRAWINGS

FIGS. 3 A—A, 3 B—B, and 3 C—C are enlarged partial sectional views taken along lines A—A, B—B, and C—C respectively in FIG. 3;

DETAILED DESCRIPTION OF THE INVENTION

Figure 1:
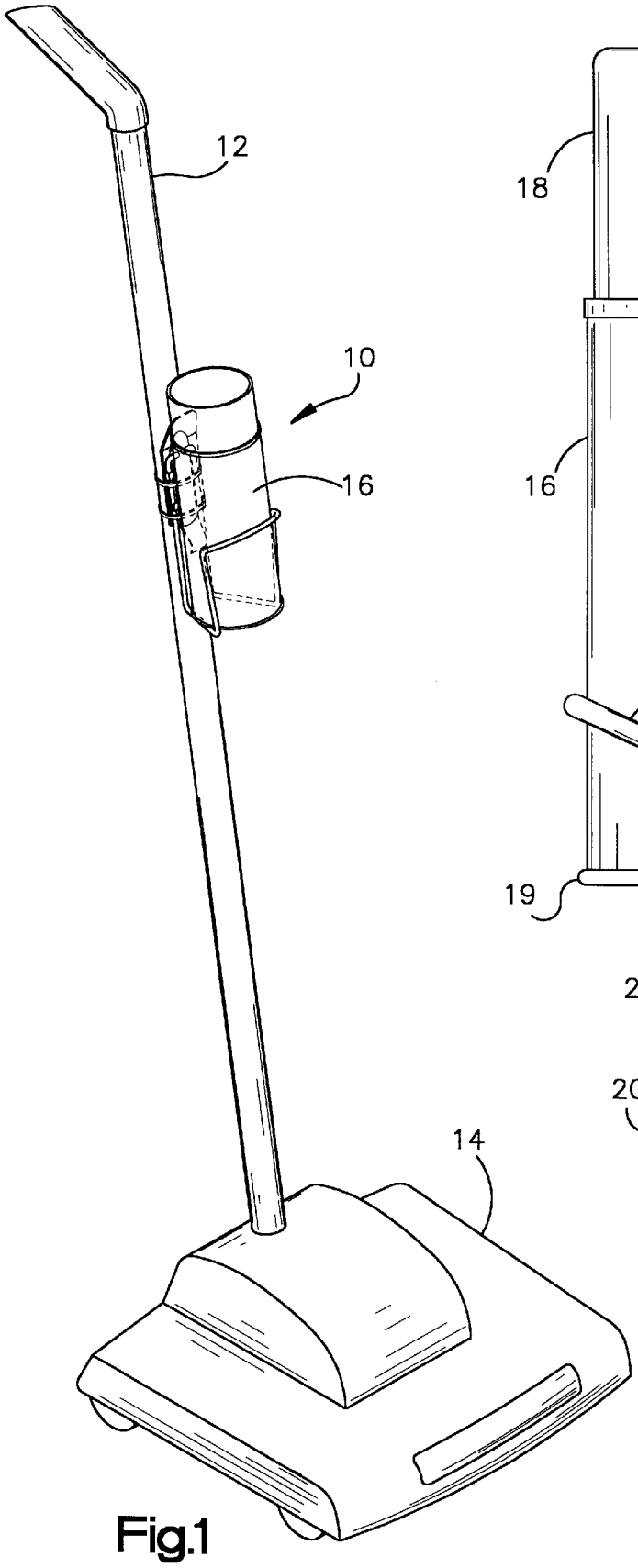
FIG. 1 is a vertical perspective view of a vacuum cleaner containing the detachable holding device secured to the upright handle of the vacuum cleaner.

Referring now to the drawings wherein like reference numbers indicate like parts, shown is a container holding device 10 of this invention secured to an upright handle 12 attached to a floor maintenance apparatus such as a vacuum cleaner base 14, where the holding device 10 is adapted to hold and support a removable fluids container 16 in accordance with this invention.

Figure 2:
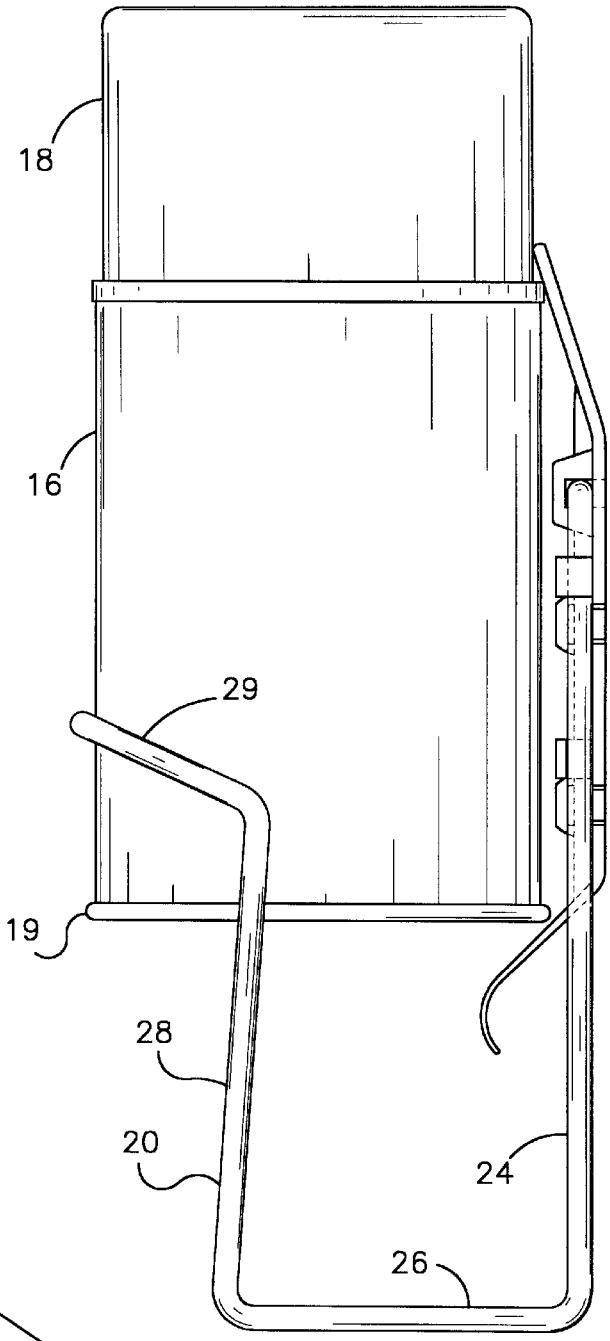
FIG. 2 is a vertical side view of the holding device removed from the upright handle in FIG. 1 and showing a container of fluid partially inserted into the holding device.
Figure 6:
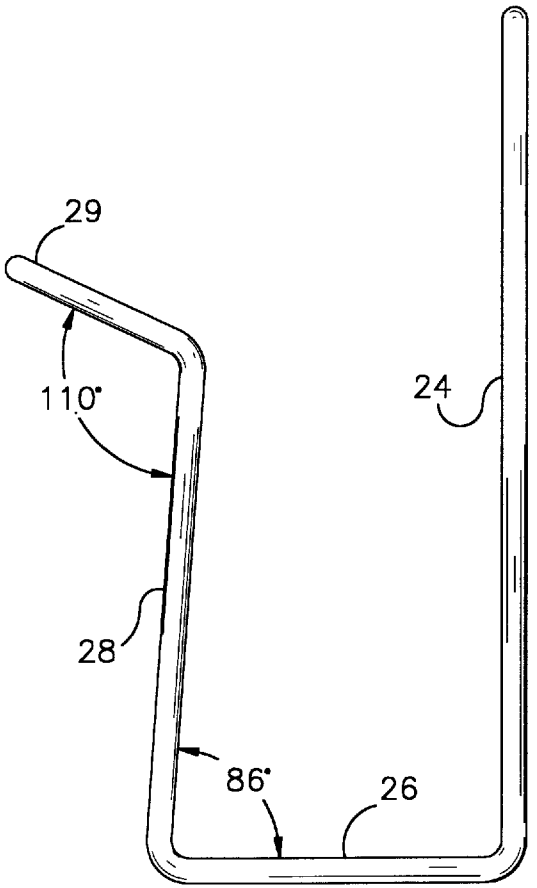
Figure 6 is a vertical side view of the formed wire supporting structure shown in FIG. 5.
Figure 5:
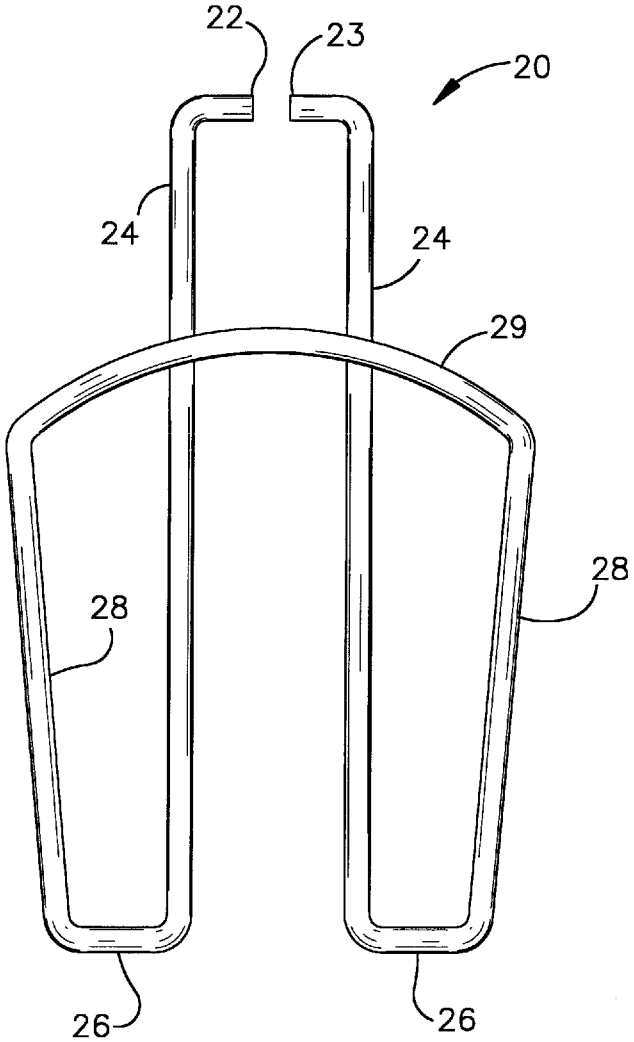
FIG. 5 is vertical front view of the formed wire supporting structure removed from the holding device in FIG. 2.

The container holding device 10 can be attached to or removed from the upright handle 12 and is adapted to hold the fluids container 16, as is shown in vertical side view in FIG. 2, where the container 16 has a top cap 18 and a bottom 19 partially inserted into the structure of the holding device 10. The structure of the holding device 10 includes a formed rigid support means 20, such as extruded aluminum wire shown in isolation in FIGS. 5 and 6. The formed supporting means 20 comprises two horizontally disposed upper distal ends 22, 23, each bent in opposed horizontal alignment. The distal ends 22, 23 each contain a first bend to extend downwardly into laterally spaced parallel depending elongated vertical members 24, then a second bend to outwardly disposed horizontal members 26 diverging outwardly, then a third into upwardly directed outer vertical members 28 laterally spaced outwardly from the respective vertical members 24, and interconnected by a common rounded or arcuate upper member 29, where the formed wire structure is adapted to securely support the fluids container 16 in use. The outwardly extending lower horizontal extruded members 26 preferably are laterally biased to diverge laterally as the horizontal members extend outwardly. The formed wire supporting structure therefore comprises a formed wire extrusion particularly formed with multiple right angle bends where a first bend is formed between the distal ends 22,23 and the respective vertical members 24, a second bend with vertical members 24 and the lower horizontal members 26, and a third bend between the lower horizontal members 26 and the outer vertical members 28, and a common interconnecting arcuate bend 29. The formed extrusion holder 20 functions as a supporting structure for the fluids container 16 and is further supported by secure attachment to a main body structure of a preferably rigid molded plastic body structure 30.

Figure 3:
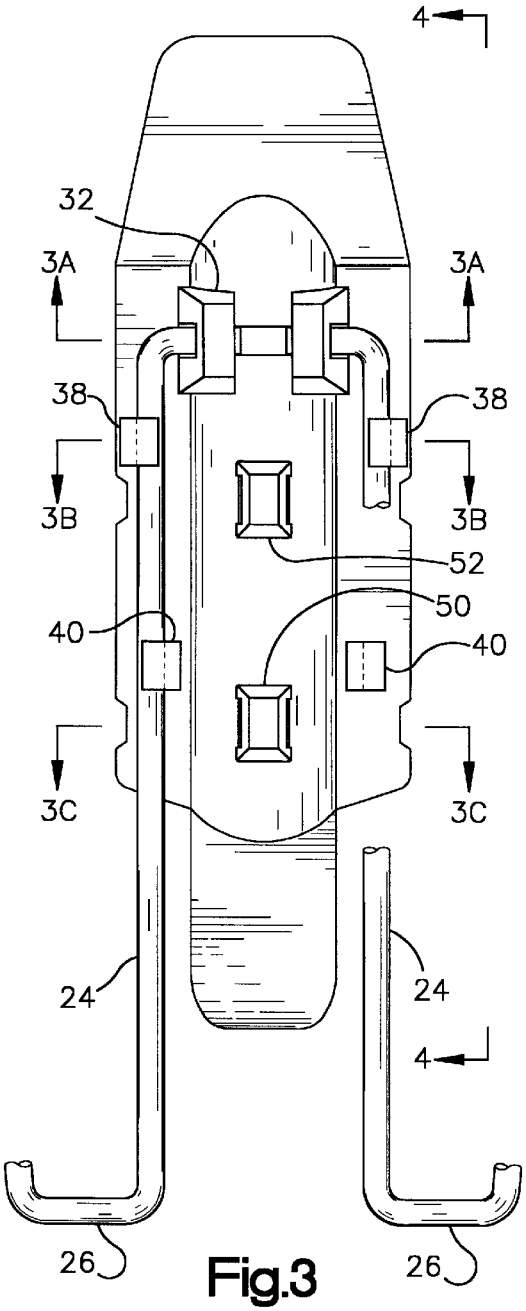
FIG. 3 is a vertical front view of the holding device shown in FIG. 2 with the fluids container removed.
Figure 4:
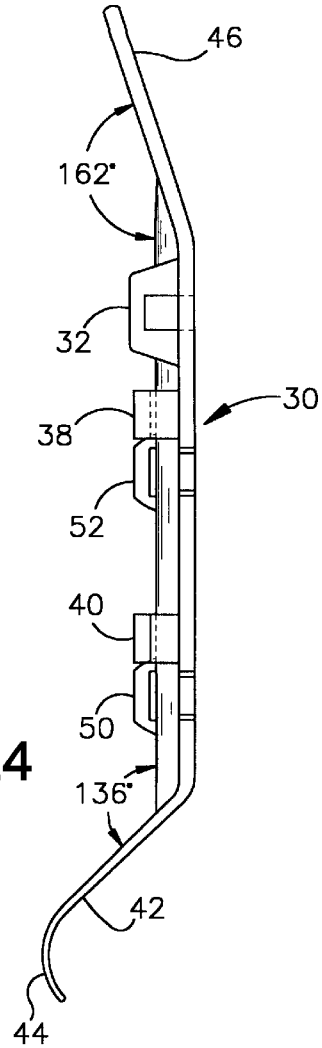
Figure 4 is vertical side view of the holding device shown in FIG. 3 but with the formed wire supporting structure removed.
Figure 3A:
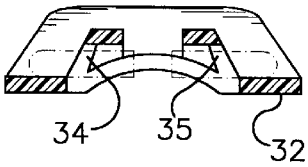
Figure 3B:
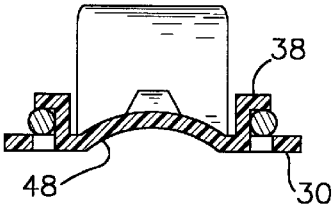

The main body structure 30 of the holding device 10 is best shown in FIGS. 3 and 4 and preferably comprises molded plastic with integrally formed structures to securely lock the formed extrusion support means 20 to the body structure 30. In this regard, the molded plastic body member 30 contains an upper molded locking means 32 having laterally spaced outward lateral openings 34,35, as best shown in FIG. 3 A—A, on the outward sides and each adapted to securely friction lock the respective distal ends 22, 23 of the formed extrusion holder 20. Each side of the front of the molded body structure 30 contains a pair of vertically spaced but laterally opposed cooperating vertical lock means consisting of L shaped molded arms each adapted to partially overlap and lock a respective vertical member 24 of the extrusion holder 20 in place against the main body structure 30. The pair of vertically spaced molded lock means consist of an upper lock 38 having an L shaped arm facing laterally inwardly and a lower lock 40 having an L shaped arm facing laterally outward, whereby each elongated vertical wire member 24 of the extrusion holder 20 is maintained in secure locking engagement with the body structure 30, while particularly maintained in vertical locking engagement between the opposed upper and lower L shaped vertical locks 38 and 40. In FIG. 3, the right vertical member 24 of the extrusion holder 20 is partially removed to better illustrate the opposed vertical locks 38 and 40 while the left side shows the continuous left vertical member 24 in locking engagement with the upper and lower locks 38 and 40 where the upper L shape locking arm faces laterally inwardly and the lower L shape locking arm faces laterally outwardly.

The molded body structure 30 further contains cooperating impinging means adapted to impinge upon and frictionally secure by resilient impingement upon the fluids container 16 within the holding device 10. As shown best in FIG. 4, the molded body structure 30 contains a lower depending impinging member 42 extending outwardly and downwardly from the main body structure 30 for secure impinging engagement on the lower part of the fluids container 16. The lower impinging member 42 is sufficiently resilient to flex inwardly toward the upright handle when the fluids container 16 is being inserted, as shown in FIG. 2, and preferably contains an inwardly directed arcuate distal terminal end 44 to facilitate insertion and removal of the fluids container 16 within the formed wire support means 20. A typical useful inward angle bend for the lower impinging member 42 is 136 degrees relative to the vertical, as shown in FIG. 4. The upper end of the molded body structure 30 similarly contains an upper impinging member 46 extending primarily upwardly, but somewhat outwardly, where the impinging member 46 is adapted to flex sufficiently inwardly to impinge upon the midsection of the fluids container 16 or the container top cap 18, as shown in FIG. 2, depending on the size of the fluids container 16. The upper impinging member 46 functions to stabilize the vertical alignment of the fluids container 16 within the container holding device 10 as well as secure the fluids container 16 in the formed wire support means 20 while in use.

Figure 7:
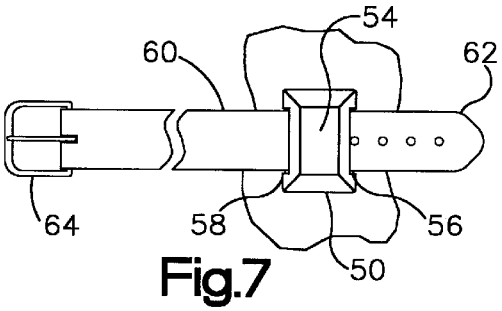
FIG. 7 is an isolated enlarged vertical front view of a strap holder shown in FIG. 3 and in section in FIG. 3 C—C with a strap inserted through the strap holder.
Figure 3C:
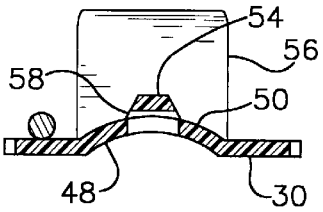

The molded main body structure 30 is molded with an arcuate inside surface 48, as illustrated in FIGS. 3 B—B and 3 C—C, to smoothly engage the normally circular upright handle 12 of the vacuum cleaner 14 or similar floor maintenance apparatus. The container holding device 10 is attached to the upright handle 12 by attaching means, such as a flexible belt 60, as shown in FIG. 7. The molded body structure 30 contains two vertically spaced raised molded strap holder slot mechanisms 50, 52 where each contains a raised top 54 and a pair of intermediate laterally spaced slit openings 56, 58 to provide slot openings to insert the attaching flexible belt 60 as shown in Figure 7. The flexible belt 60 has a distal end 62 with multiple locking openings adapted to lock with the other distal end buckle 64 to thereby secure and lock the container holding device 10 to the upright handle 12.

In use, the container holding device 10 can be strapped or otherwise secured to the upright handle 12 of the mobile floor maintenance apparatus 14. A fluids container 16 can be inserted within the formed wire support means 20 such that the lower and upper impinging members 42 and 46 impinge upon and frictionally secure the container 16 in a stable upright direction parallel to the adjacent upright handle 12. While using the mobile cleaning or polishing maintenance apparatus 14, the operator can in this manner carry the auxiliary cleaning or polishing fluids or similar maintenance type fluids on the upright handle of the mobile maintenance apparatus while performing the primary maintenance activity. When needed, the fluids container 16 can be quickly removed from the holding device 10 to expediently perform the auxiliary maintenance task, and, when completed, the fluids container 16 can be simply reinserted within the holding device 10 in the same manner as before. The fluids container ordinarily would contain flowable materials such as aerosol sprays, liquids, gels, pastes, semi-solids, or even solid materials such as hard wax.

Although preferred embodiments of this invention have been described in particularity in respect to the drawings, the invention is not intended to be limited except as set forth in the appended claims.

It is claimed:

1. In combination with a mobile floor maintenance apparatus having an upright handle, a container holding device attached to the upright handle for holding a small container of cleaning maintenance material, where the container holding device comprises:

a vertically orientated molded plastic body structure having an inward surface engaging the upright handle, the body structure adapted to be secured to the upright handle and having attachment means for locking the holding device to the upright handle of the maintenance apparatus;

the body structure supporting an outwardly disposed formed support means extrusion holder for supporting the fluids container in an upright direction, the formed support means being a particularly formed extrusion member having upper opposed distal ends secured to the body structure, each distal end having a top bend forming a downwardly depending vertical member, the two downwardly depending vertical members being laterally spaced and each in locking engagement with the body structure, each downwardly depending vertical member having an inner bottom bend forming an outwardly directed bottom horizontal member adapted to support the bottom of the fluids container, each horizontal member having an outer bottom bend forming an outer upright member disposed vertically and adapted to engage the outer vertical walls of the fluids container, where each outer upright member has an outer upper bend forming a common transverse arcuate member interconnecting with each outer upright member to form a formed support means, where the transverse arcuate member is adapted to engage the upper part of the fluids container disposed within the formed support means;

the body structure having an upwardly extending, outwardly orientated impinging member for engaging the upper portion of the fluids container held within the extrusion holder, and a lower downwardly depending, outwardly directed, lower impinging member sufficiently resilient to retract inwardly to secure by friction engagement the lower part of the fluids container within the extrusion holder, where the upper impinging member and the lower impinging member maintain the fluid container in an upright direction secured within the formed support means in use and permit insertion and removal of the fluids container; and where the body structure of the holding device contains locking means securing the laterally spaced downwardly depending vertical members of the extrusion support means to the body structure, where the locking means comprises a first molded locking means for securing one of the depending vertical members and a second molded locking means for securing the other depending vertical member, where the first and second molded locking means each comprises an upper lock and a lower lock, where the upper lock and the lower lock are laterally opposed to lock engage the respective depending vertical member between the laterally opposed upper and lower locks, where each upper lock is L shaped and each lower lock is L shaped, and each L shaped lock structure securely engages the respective depending vertical member by friction engagement between the laterally opposed upper and lower L shaped structures.

2. The holding device in claim 1 where the extrusion support means is a continuous metal extrusion of rigid wire formed into the structure of the support means for holding the fluids container.

3. The holding device in claim 1 where the outwardly extending bottom support members diverge laterally as each bottom support member extends outwardly.

4. The holding device in claim where the attachment means comprises two vertically spaced molded slot means, where each slot contains an adjustable flexible locking belt.

5. The holding device of claim 1 where the inside surface of the body structure is an arcuate concave surface for engaging a circular upright handle.

6. The holding device of claim 1 where the attachment means comprises at least one molded slot means, where the slot means receives an adjustable belt for attaching the holding device to the upright handle.

* * * * *